US006681439B1

(12) United States Patent
Kohlruss et al.

(10) Patent No.: US 6,681,439 B1
(45) Date of Patent: Jan. 27, 2004

(54) CLEANING DEVICE

(76) Inventors: Gregor Kohlruss, Pater-Eugen-Breitensteinstrasse 1, 46325 Borken (DE); Hubert Wiesner, Grüner Weg 21, 46354 Südlohn (DE); Oliver Griebe, Heideweg 12, 46414 Rhede (DE)

( * ) Notice: Subject to any disclaimer, the term of this patent is extended or adjusted under 35 U.S.C. 154(b) by 78 days.

(21) Appl. No.: 10/049,340

(22) PCT Filed: Aug. 11, 2000

(86) PCT No.: PCT/EP00/07818

§ 371 (c)(1),
(2), (4) Date: Apr. 26, 2002

(87) PCT Pub. No.: WO01/12053

PCT Pub. Date: Feb. 22, 2001

(30) Foreign Application Priority Data

Aug. 12, 1999 (DE) ..... 199 38 222

(51) Int. Cl.[7] ..... A47L 1/06; A47L 13/12
(52) U.S. Cl. ..... 15/245; 15/121
(58) Field of Search ..... 15/121, 245

(56) References Cited

U.S. PATENT DOCUMENTS

| | | | | |
|---|---|---|---|---|
| 1,684,604 | A | | 9/1928 | Stoessel |
| 2,691,185 | A | | 10/1954 | Jones |
| 5,809,605 | A | * | 9/1998 | Gringer |

FOREIGN PATENT DOCUMENTS

| | | |
|---|---|---|
| DE | 297 15 454 | 1/1998 |
| EP | 0 782 835 | 7/1997 |
| EP | 0 811 349 | 12/1997 |
| EP | 0 914 794 | 5/1999 |
| FR | 2 753 075 | 3/1998 |

* cited by examiner

*Primary Examiner*—Randall E. Chin
(74) *Attorney, Agent, or Firm*—Collard & Roe, P.C.

(57) ABSTRACT

The invention relates to a cleaning device for manually cleaning surfaces with a support from dimensionally stable material on which at least one cleaning element is mounted. The aim of the invention is to provide a device with which damages to sensitive surfaces that are caused by an inadvertent contact with the dimensionally stable material can be substantially avoided. To this end, the support is at least partially provided with an elastically deformable, shock-absorbing cover.

9 Claims, 1 Drawing Sheet

CLEANING DEVICE

CROSS REFERENCE TO RELATED APPLICATION

Figure 1:
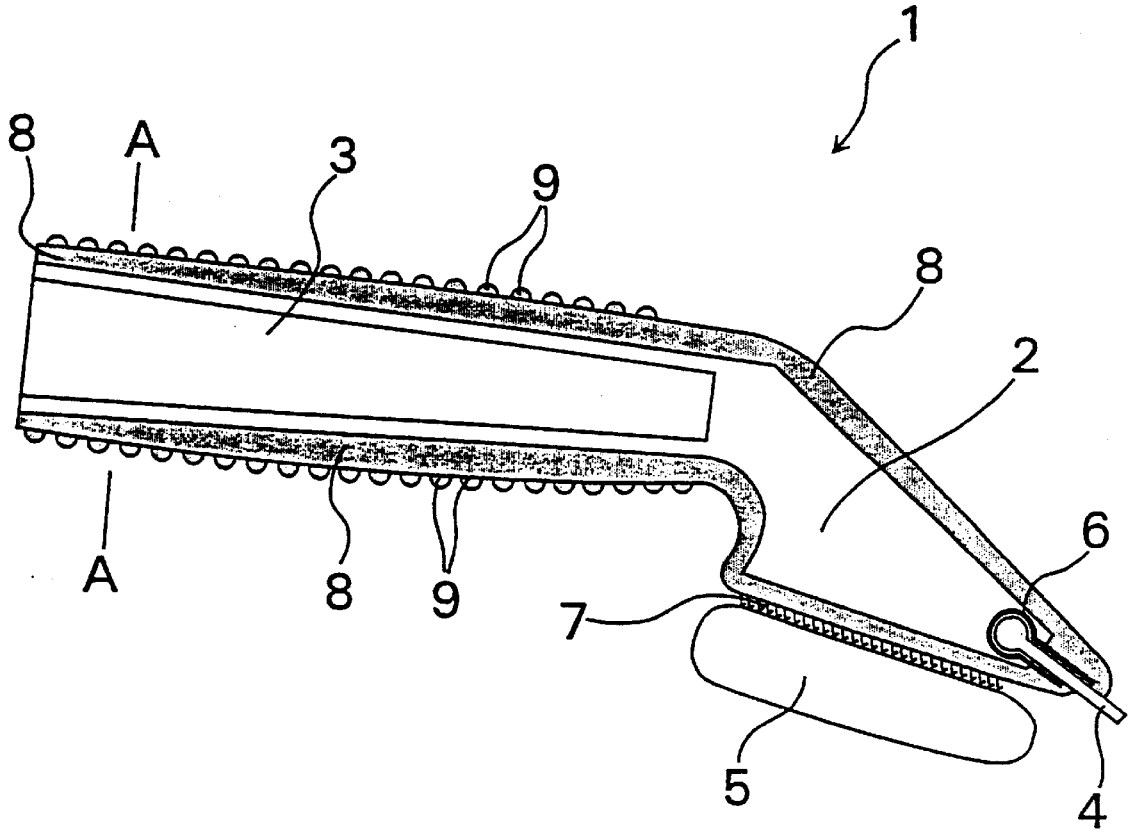

Applicants claim priority under 35 U.S.C. §119 of German Application No. 199 38 222.0 filed Aug. 12, 1999. Applicants also claim priority under 35 U.S.C. §120 of PCT/EP00/07818 filed Aug. 11, 2000. The international application under PCT article 21(2) was not published in English.

The invention relates to a window wiper for manually leaning window surfaces, comprising a support made of dimensionally stable material that is provided with a holding profile made of dimensionally stable material as well for holding a rubber wiper blade.

Window wipers of the type specified above are known in a great variety of different designs. For cleaning window glass panes, such window wipers comprise a rubber wiper strip as it is described, for example in EP 0 811 349 A1, or DE 297 15 454 U1.

So that an adequate and uniform contact pressure can be manually applied to the rubber wiper strip, the components serving in this regard as abutments, notably the support and the holding profile secured on the latter, have to be designed with adequate dimensional stability. In particular, the holding profile has to be prevented from bending through when it is used. In connection with the window wipers of the type specified above known in the prior art, the support and the holding profile are for that reason made of metal or a correspondingly hard and resistant plastic such as, for example ABS (acrylo-nitrile-butadiene-styrene) in most cases.

Furthermore, the use of such dimensionally stable, resistant materials for the support offers the advantage that window wiper is functionally safe and robust and has a long useful life. This, however, is opposed by the drawback that sensitive surface are endangered if they inadvertently come into contact with the support or the holding profile, which is practically hardly avoidable with normal use. For example, window frames made of aluminum or genuine veneer can be scratched when a window is cleaned with a window wiper of the known type. Furthermore, surfaces are damaged time and again when such a window cleaning device is inadvertently dropped, which cannot be entirely excluded even if the usual care is exercised in daily practice.

According to the state of the art (FR-A-27 53 075), it is known in connection with furniture cleaning devices to provide the support—which is rigid as well—on all sides with a soft, yielding cover in order to prevent the surfaces to be cleaned in furniture cleaning from being damaged. However, in connection with said known furniture cleaning devices, the cleaning elements are mounted on the outer side on the elastic cover and are therefore not supported in a uniform manner. If one were to secure and support the rubber wiper strip of a window wiper on such a cover, the function of the window wiper would be considerably impaired.

Therefore, the problem of the invention is to further develop the window wiper of the type specified above to such an extent that the surface to be cleaned is carefully treated without impairing the guidance and support of the rubber wiper strip.

For solving said problem, the invention proposes based on the window wiper of the type specified above that the support and the holding profile are provided on all sides with an elastically yielding, shock-absorbing cover, with the exception of the point where the wiper strip protrudes with its wiper blade.

The window wiper as defined by the invention, except for the point where the wiper strip protrudes with its wiper blade, is covered with a soft, shock-absorbing cover. Such a cover or jacketing is elastically deformable, so that it automatically assumes again its original form after it has been stressed.

The special advantage of the window wiper as defined by the invention consists in that sensitive surfaces cannot be damaged even if the window wiper is handled in a careless manner provided it is used based on the forces and stresses normally occurring in manual cleaning work. All edges and corners of the support and the holding profile are covered in a shock-absorbing and soft manner, so that there is no longer any risk that window frames, for example, are damaged or scratched. This applies to inadvertent shock stresses as well, which occur when the window wiper is dropped, because owing to the shock-absorbing effect of the cover as defined by the invention, punctual stresses will no longer occur, but only a short elastic deformation of the material of the cover.

The embodiment of the window wiper as defined by the invention do not in any way have a negative influence on the advantages of use of the window wiper. It is rather possible to consequently optimize the stability of the support and the holding profile with respect to the requirements of the given purpose of application. For example, it is conceivable to produce the holding profile for supporting the rubber wiper strip from a particularly hard material with bending stiffness, for example from hardened steel sheet or the like, in order to achieve an optimal contact and accordingly good cleaning results. The shock-absorbing cover nonetheless does not pose any risk that this could have any damaging effects should the support of the window wiper inadvertently come into contact with sensitive surfaces, for example when touching an aluminum window frame.

The cover is usefully secured on the support in an undetachable manner. It is assured in this way that the comprehensive protection afforded by the embodiment as defined by the invention is available at any time even when the device is used over a long period of time.

It is particularly advantageous if the cover is formed by an elastically yielding plastic foam material, in particular made from foam with closed pores, for example from polyurethane (PU), which exhibits both good shock-absorbing and elastic properties even if it has a thickness in the order of magnitude of only millimeters. Furthermore, a plastic foam cover has a very low weight, which is positive for the handiness of a hand-held device in any case. Furthermore, the technique of foam application all around can be carried out in a particularly rational manner and permits the targeted shock-absorbing cushioning of critical points in that the thickness of the foam material is locally increased at such points, because the local shaping of such a foam cover is substantially freely selectable. Irrespectively of the shape of the basic body, i.e. the support in connection with the invention, the material of the cover is in a particularly intimate contact with the surface of the support according to the present manufacturing process, so that a particularly solid and durable bond is obtained. This, of course, is to the benefit of the useful life of the window wiper even if the latter is used under rough conditions here and there.

A handle is preferably attached to the support that is provided with a cover as well. Such a handle may either form one single piece jointly with the support, or it may be mounted also on an extension handle bar that can be connected to the support in a detachable manner. While the first-mentioned variation represents a particularly compact manual cleaning device, the action radius is accordingly expanded with the second variation by the extension bar. It is conceivable also that an extension bar can be connected also to the embodiment in which the support and the handle jointly form one single piece.

The handiness of the window wiper is noticeably enhanced further by the embodiment of the handle as defined by the invention because the yieldingly elastic cover in the area of the handle adapts itself to the hand when it is gripped, and in this way provides for particularly safe gripping of the handle. This comes to bear especially when the handle gets wet, as it usually the case in connection with manual wet cleaning work, where handles made of a rigid material become smooth and slippery, which, of course, favors slipping of the handle from the hand or unintended contact with the surfaces to be cleaned. This is not the case in connection with the invention because the covered handled is a particularly safe, sure-grip type handle under all conceivable conditions of use.

If the cover is realized in the form of a cover made of plastic foam, its use, furthermore, is perceived as being particularly pleasant by the user because plastic foam has a good thermal insulating effect. Such a handle feels pleasant even at cool ambient temperatures, which, of course, is to the benefit of the user friendliness as well.

It is advantageous for ergonomic handling that the cover of the handle has molded-in features. It is possible in this way, for example to mold-in recesses for gripping by the individual fingers, so that a form-locked, safe grip is achieved with one hand. According to an advantageous further development of the invention, provision is made that the moldings comprise a multitude of projecting naps. Due to the punctual contact with the skin, such naps provide for a blood circulation-promoting massage of the palm of the hand as the window wiper is being used. This is subjectively perceived as being pleasant in most a cases and permits longer fatigue-free working on account of the circulation-promoting effect.

In the embodiment of a window wiper as defined by the invention, the cleaning element may be mounted on the support in a fixed manner or alternatively in a detachable way. While mounting the cleaning element in a fixed manner provides for a particularly safe support of the cleaning element, mounting it in a detachable way offers the advantage that the cleaning element can be easily replaced when it is worn, or for different cases of application. For mounting it in a detachable way, the rubber wiper blades, for example, can be laterally inserted in corresponding receiving profiles.

In connection with the invention, the support may be one single piece made of metal or plastic, or it may be a combination of the two, for example with metal profiles, connector pieces and the like injected into plastic material.

Figure 2:
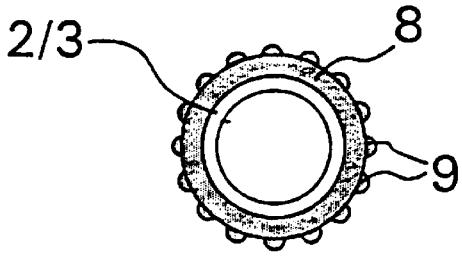

An exemplified embodiment of the invention is explained in the following in greater detail with the help of the drawing, which shows the following in detail:

FIG. 1 is a longitudinal section through a window wiper as defined by the invention; and FIG. 2 is a cross section through a window wiper as defined by the invention according to FIG. 1.

The representations in FIGS. 1 and 2 show a cleaning device as defined by the invention in the form of a window cleaning device, i.e. a manual cleaning device for cleaning smooth surfaces. Said cleaning device as a whole is denoted by the reference symbol 1. Identical reference numerals are used in the two representations for identical components.

FIG. 1 shows a longitudinal section through the center of the cleaning device 1. Said cleaning device has in its interior a support 2 serving as the supporting structure. The basic body of said support is preferably made of plastic, for example ABS. At the bottom, i.e. in the drawing to the left, the support merges into a tubular handle 3. The opening of said tube forms at the same time a connector piece for connecting an extension handle bar or the like. In the front area, a rubber wiper blade 4 is mounted on the support 2 as a cleaning element, and offset to the rear, a microfiber cleaning cushion 5 is mounted as another cleaning element.

The wiper blade 4 is laterally inserted in a form-locked manner in a metal holding profile 6, thus into the plane of the drawing in the present representation. Said holding profile is forming a component of the support 2 that is joined with the plastic body in an undetachable manner. The microfiber cleaning cushion 5 is detachably connected with the support 2 via an area zipper 7, for example a Velcro-type closure.

According to the invention, the special feature of the cleaning device shown consists in that the support 2 including its plastic body, the handle 3, as well as the metal holding profile 6, is provided on the outside on all sides with an elastically yielding, shock-absorbing cover 8. Said cover is realized in the form of an elastically yielding plastic foam, preferably polyurethane foam, and has a thickness of between about 0.5 mm and 3 mm.

In the front area, the cover is covering all outer sides of the support 2 with the exception of the point where the wiper blade 4 protrudes with its wiping edge. The Velcro closure 7 for fastening the microfiber cushion 5 may be mounted either directly on the support 2 or also externally on the cover 8.

The tubular handle 3 is completed enclosed on the outer side by the cover 8 as well, which is clearly shown in the representation of FIG. 2, which shows a cross section A—A according to FIG. 1. One special feature of the handle 3 consists in that the cover 8 is provided there with a multitude of the radially protruding, rounded naps 9. Owing to said naps, which are yielding as well due to the yielding property of the PU foam used for the cover 8, a higher gripping safety and a pleasant gripping feel are achieved in that the palm of the hand is massaged when the hand is gripping the handle.

An extension bar not shown here can be inserted in the rearwardly open connection opening in the handle 3, if needed. At least in its zone where it is gripped, such an extension bar should comprise a handle as well, which is realized in the same way as the handle 3 of the cleaning device 1 shown.

The cleaning device 1 shown has a particularly stable support 2 made of impact-resistant plastic, whereby the as dimensional stability required in the zone of the wiper blade 4 is assured by the metal holding profile 6 arranged in said zone. By virtue of the embodiments with the cover 8 as defined by the invention, said cleaning device 1 offers the special advantage that even sensitive pieces of furniture or floor surfaces are not scratched or damaged in some other way when they come into contact with the cleaning device, because the hard material of the support 2, and in particular the metal holding profile 6 are completely cushioned with the soft, shock-absorbing cover 8. Therefore, taking into account the care usually exercised, inadvertent damage is practically excluded.

Another advantage is that the ergonomic quality of the handle 3 is raised by the yielding cover 8, and that pleasant working is possible by virtue of the naps 9 as well.

What is claimed is:

1. A window wiper for manually cleaning window surfaces, comprising a support (2) made of dimensionally stable material and provided with a holding profile (6) for a rubber wiper strip (4), said holding profile being made of a dimensionally stable material as well, characterized in that the support (2) and the holding profile (6) are covered on all sides with an elastically yielding, shock-absorbing cover (8), with the exception of the point where the wiper strip (4) protrudes with its wiper blade.

2. The window wiper according to claim 1, characterized in that the cover is an elastically yielding plastic foam.

3. The window wiper according to claim 1, characterized in that the foam cover (8) consists of polyurethane foam with closed pores.

4. The window wiper according to claim 1, characterized in that the support (2) and the handle (3) jointly form one single piece, said handle being covered by the cover (8) as well.

5. The window wiper according to claim 4, characterized in that the handle (3) is mounted on an extension bar that is detachably connectable with the support (2).

6. The window wiper according to claim 4, characterized in that the cover (8) of the handle (3) comprises moldings.

7. The window wiper according to claim 6, characterized in that the moldings comprises a multitude of projecting naps (9).

8. The window wiper according to claim 1, characterized in that the support (2) consists of metal.

9. The window wiper according to claim 1, characterized in that the support (2) consists of plastic.

* * * * *